United States Patent [19]

Hartnell

[11] 4,316,545

[45] Feb. 23, 1982

[54] HANGING TOOL TRAY

[76] Inventor: Dale A. Hartnell, 410 E. Eighth St., Centralia, Ill. 62801

[21] Appl. No.: 47,204

[22] Filed: Jun. 11, 1979

[51] Int. Cl.[3] ..... A47F 7/00; E21B 19/14

[52] U.S. Cl. ..... 211/60 T; 248/318

[58] Field of Search ..... 248/318; 211/60 T, 113; 108/149, 27

[56] References Cited

U.S. PATENT DOCUMENTS

| | | | |
|---|---|---|---|
| 778,786 | 12/1904 | Kramer | 248/318 UX |
| 1,443,022 | 1/1923 | Hielscher | 248/318 |
| 3,228,577 | 1/1966 | Croft | 248/318 UX |
| 3,269,550 | 8/1966 | Marcus | 211/60 T UX |
| 3,901,165 | 8/1975 | Schlesinger | 108/149 |

FOREIGN PATENT DOCUMENTS

| | | | |
|---|---|---|---|
| 534812 | 1/1955 | Belgium | 108/149 |
| 4841 | 1/1894 | Sweden | 211/113 |

*Primary Examiner*—J. Franklin Foss

*Attorney, Agent, or Firm*—Glenn K. Robbins

[57] ABSTRACT

A hanging tool tray for supporting tools, parts and the like. The hanging tool tray is comprised of a flat tray-like base having shallow sides and is of generally rectangular configuration. Supporting cables are connected to the four corners and extend above the tray to provide a loop which is hooked in an eye of an elongated hook having an open C-shaped hook at the top. The top hooked end can be hooked over a part of an automobile when the workman is working upon it to provide easy access to the supported tray positioned adjacent the workman. The sides of the tray have horizontally extending flanges or ledges with holes provided for reception for screw drivers, pliers and other tools.

1 Claim, 4 Drawing Figures

HANGING TOOL TRAY

SUMMARY OF THE INVENTION

In the past, workmen, in the construction trades, mechanics working on automobiles, and other types of workmen have traditionally had a problem with regard to supporting tools and parts upon which they are working in the area of work. Such tools and parts such as nuts, bolts and the like are easily mislaid and when supported upon supports, such as automobile engine, frame or the ground are easily dislodges and lost.

By means of this invention, there has been provided a simply designed hanging tool tray which can be supported to various parts of automobile when the automobile is on a hydraulic lift or the like. The tool tray may likewise be supported on accessible portions of tool cabinets or other structures over which the supporting hook of the tray may be supported and positioned. The tray is supported by flexible cables which are gathered at the top to support the tray with a fixed loop being formed which is fitted within an eye of a suspension hook. The suspension hook is elongated and above the eye has a wide open C-shaped hook member. The hook member may be simply hooked to various supports in order that the tray can be simply supported.

The tray is further provided with shallow upstanding sides at the four corners of the rectangular shaped tray base. These sides serve to keep tools and parts such as nuts and bolts and the like within the tray and prevent then from being lost and mislaid. At the sides of the tray there are outwardly extending horizontal flanges or ledges within which a series of holes are provided. These holes receive screw drivers, pliers and other tools making them readily available to the workman.

By means of the suspension cables connected to each of the four corners the tray is not only supported, but makes possible the provision of a loop formed in the intermediate portions of the cables which is fixed by a collar or swage and is of small size so that it may be easily fitted in the eye of the suspension hook. Thus, the tray may be moved by the workmen as desired while still being supported. Further, the hook may be supported on a vertical wall whereever a part of the wall lends itself to the C-shaped hook being anchored or hooked. When so supported to a verticall wall, so that the hook is to one side of the center of the tray by means of the flexible cables only two cables will be under tension. The other two support cables will be slack to maintain the tray in horizontal relationship. Thus, the tray has great adaptability through the flexibility of the suspension cables, ropes or the like which are used to support the tray from the four corners through the eye of the hook. The tray may be simply used in a number of different environments in industry, garages, workshops, households and the like. Further, through its rugged and simple construction it is inexpensive in cost and can be simply used in a wide variety of applications.

The above features are objects of this invention and further objects will appear in the detailed description which follows and will be otherwise apparent to those skilled in the art.

For the purpose of illustration of this invention there is shown in the accompanying drawings a preferred embodiment thereof. It is to be understood that these drawings are for the purpose of example only and that the invention is not limited thereto.

IN THE DRAWINGS

DESCRIPTION OF THE INVENTION

Figure 1:
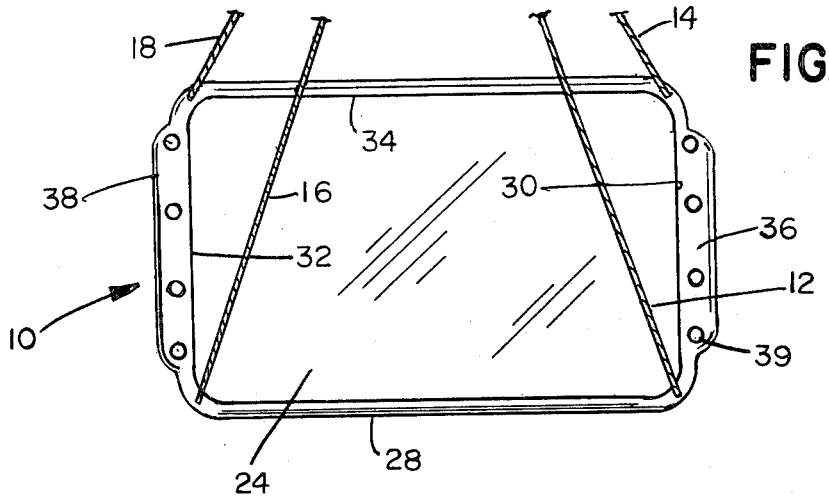
FIG. 1, is a top plan view of the tray with the suspension wires partially broken away.

The tool tray of this invention is generally designated by the reference numeral 10 in FIGS. 1 through 4. The tray is suspended by four flexible cables 12, 14, 16 and 18 and a specially formed hook 20 at the top passing through a closed gathered loop 22 formed in the cables.

Figure 2:
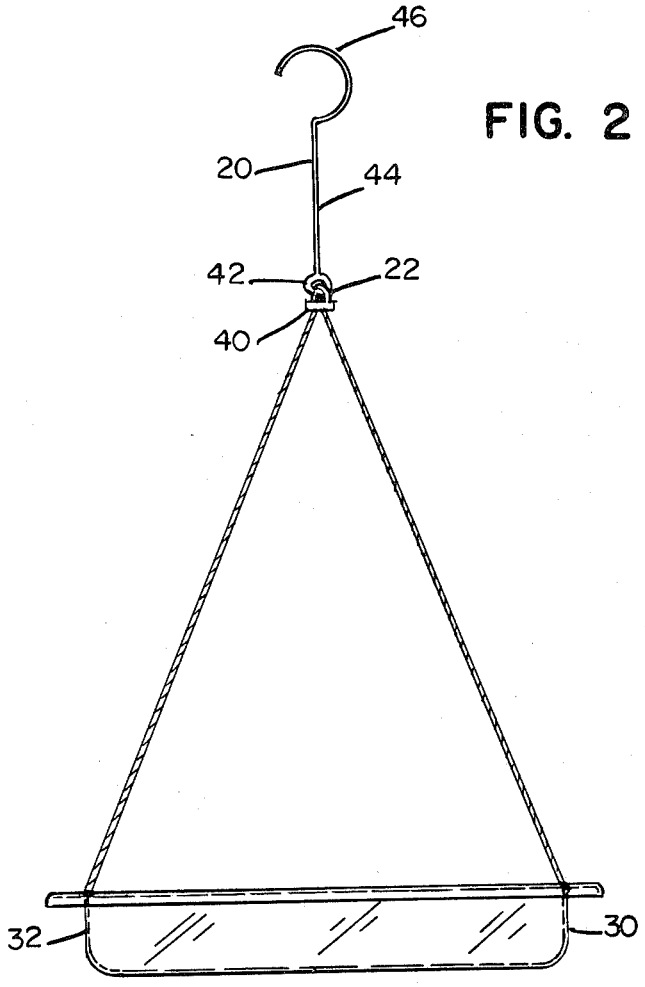
FIG. 2, is a view in front elevation of the tool tray.

The tool tray as best shown in FIGS. 1 and 2 has a bottom 24, front wall 28, vertical side walls 30 and 32 and vertical rear wall 34. These walls at their upper edges have horizontally extending flanges which are widened at side wall portions to provide widened flanges 36 and 38. Both of the side wall flanges 36 and 38 have a multiplicity of openings 39 to receive screw drivers, pliers and other conventional tools.

The four suspension cables 12, 14, 16 and 18 are anchored to the corners of the tray and are simply formed by two lengths of flexible aircraft cable or other cable like rop-like means. Two lengths of such cables are utilized in order that the gathered loop 22 may be formed in the middle as shown in FIG. 2. A swage or collar 40 or other constricting device is used to clamp the cables together to form the gathered loop 22.

The hook 20 as best shown in FIG. 2 is comprised of an eye member 42 at the bottom which is passed through the loop 22 with the cables, an intermediate elongated shank 44 and an opne C-shaped hook 46 at the top.

USE

The hanging tool tray of this invention is adapted for very simple use in a variety of different types of environment. The hanging tool tray has a particularly advantageous use when working on various types of automobiles since the hook 20 can be very simply hooked through a spring member 48 or other part of the automobile as shown in FIG. 3 or to a tool cabinet 50 having vertical ledge-like member 52 as shown in FIG. 4 over which the hook can be attached.

Figure 4:
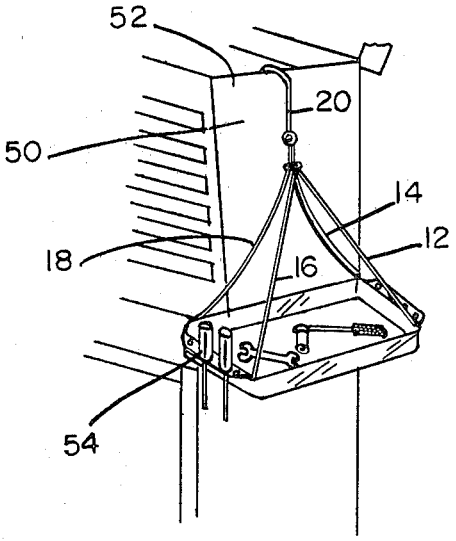
FIG. 4, is a pictorial view showing the tool tray hooked to the side of a tool cabinet.
Figure 3:
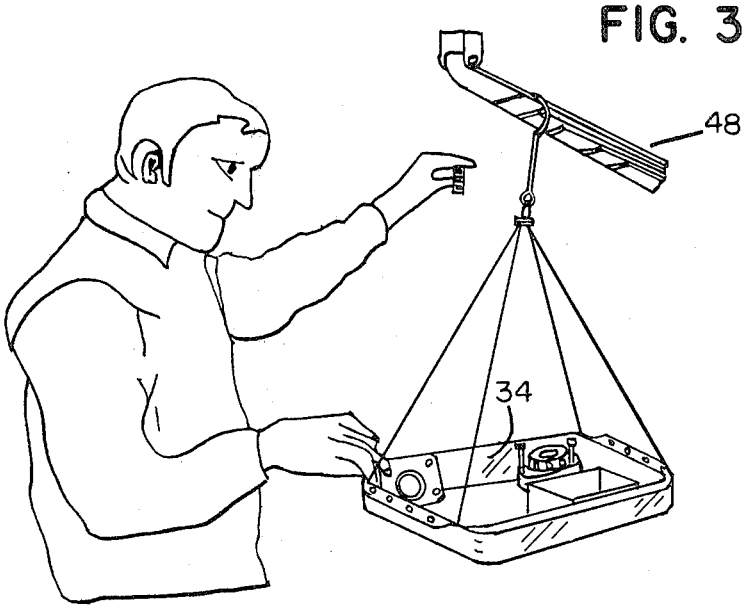
FIG. 3, is a pictorial view illustrating the tray in use and attached by the hook to the spring of an elevated automobile shown in fragmentary view.

In use the tray, as shown in FIGS. 3 and 4, can be used to deposit various parts of the automobile or other items upon which the user is working. Likewise, screw drivers 54 as shown in FIG. 4 or other tools or parts may be readily inserted in the holes for convenience and to facilitate their use as required.

Through the provision of the open hook 46 hooking of the tray upon various objects which are readily available when working upon an automobile or other area makes possible the hooking of the tray to a convenient support such that the workman can deposite the parts and tool in the tray without their being mislaid. Likewise, as shown in FIG. 4, the tray through the provision of the flexible cables can be connected from one side of the tray where the hook is supported off center such that the tray bears against the side of the cabinet as shown in FIG. 4. Thus, as shown in FIG. 4, cables 12 and 16 support the tray while the cables 14 and 18 are slakened to accommodate the offcenter hooking of the hook portion 46 over the upstanding ledge 52 of the tool vabinet.

It will be apparent that there has been provided by this invention as easily usable conveniently supported hanging tool tray which may be used for a wide variety of installations. The tray may be used by workmen in a wide variety of usages and through its ruggedness and simplicity and low cost, can find employment and utility in a wide variety of applications.

Various changes and modifications may be made within this invention as will be readily apparent to those skilled in the art. Such changes and modifications are within the scope and teaching of this invention as defined by the claims appended hereto.

What is claimed is:

1. A hanging tool tray comprised of a flat rectangular tray base having four sides connected to four shallow vertical walls and means for suspending the tray from a support, said means comprising flexible and axially yieldable suspension cable-like members connected to each of the corners of said tray, means connecting said members together below a loop formed in said cables and hook means connecting said loop through an elongated shank to an open hook member adapted to be connected to a support for supporting said tray therefrom, the four walls of said tray being provided with outwardly extending flanges and said flanges being provided with a plurality of openings receiving tools therein, said cable-like members and means connecting said members comprising a pair of cables, each of said cables being connected to a separate corner of said tray and being gathered at two separate points by a constricting member adjacent a middle portion of said cables to define an intermediate loop which is passed through an eye of said hook member to provide for free pivoting movement with respect to said hook, the constricting member being a collar which connects the cables together to form said loop.

* * * * *